US009219953B2

(12) United States Patent
Shimizu

(10) Patent No.: US 9,219,953 B2
(45) Date of Patent: Dec. 22, 2015

(54) EARPHONE MICROPHONE

(71) Applicant: Funai Electric Co., Ltd., Osaka (JP)

(72) Inventor: Noriyuki Shimizu, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/335,987

(22) Filed: Jul. 21, 2014

(65) Prior Publication Data

US 2015/0023542 A1 Jan. 22, 2015

(30) Foreign Application Priority Data

Jul. 22, 2013 (JP) ..... 2013-151664

(51) Int. Cl.

| | |
|---|---|
| ***H04R 25/00*** | (2006.01) |
| ***H04R 1/10*** | (2006.01) |
| *H04R 1/08* | (2006.01) |
| *H04R 1/22* | (2006.01) |

(52) U.S. Cl.

CPC ..... *H04R 1/1075* (2013.01); *H04R 1/08* (2013.01); *H04R 1/1016* (2013.01); *H04R 1/1083* (2013.01); *H04R 1/222* (2013.01); *H04R 2201/107* (2013.01); *H04R 2410/01* (2013.01)

(58) Field of Classification Search

CPC .. H04R 1/1016; H04R 1/1083; H04R 1/1075; H04R 1/04; H04R 1/24; H04R 2410/01; H04R 2410/05

USPC ..... 381/380, 373, 370, 371, 376, 382, 312, 381/313, 317, 322, 328, 333, 306, 388, 356, 381/357

See application file for complete search history.

(56) References Cited

U.S. PATENT DOCUMENTS

| | | | | |
|---|---|---|---|---|
| 5,298,692 | A * | 3/1994 | Ikeda et al. | 181/135 |
| 7,039,195 | B1 * | 5/2006 | Svean et al. | 381/71.6 |
| 7,983,433 | B2 * | 7/2011 | Nemirovski | 381/318 |
| 2014/0044294 | A1 * | 2/2014 | Burns et al. | 381/328 |

FOREIGN PATENT DOCUMENTS

JP 2007-201887 A 8/2007

* cited by examiner

*Primary Examiner* — Sunita Joshi

(74) *Attorney, Agent, or Firm* — Morgan, Lewis & Bockius LLP

(57) ABSTRACT

Provided is an earphone microphone capable of outputting sound with good quality and picking up clear sound. The earphone microphone includes a speaker, a microphone, a main body case, and a seal member. The seal member seals between the main body case and user's external acoustic meatus when the earphone microphone is inserted in the external acoustic meatus. The main body case is provided with an acoustic space in which the speaker and the microphone are disposed, and a first opening and a second opening which are communicated with the acoustic space. When the earphone microphone is inserted in the external acoustic meatus, the first opening is communicated with the external acoustic meatus while the second opening is communicated with outside of the main body case other than the external acoustic meatus.

14 Claims, 14 Drawing Sheets

EARPHONE MICROPHONE

This application is based on Japanese Patent Application No. 2013-151664 filed on Jul. 22, 2013, contents of which are hereby incorporated by reference.

BACKGROUND OF THE INVENTION

1. Field of the Invention

The present invention relates to an earphone microphone and particularly to an earphone microphone including a speaker and a microphone.

2. Description of Related Art

Conventionally, there is known an earphone microphone including a speaker and a microphone. A user who puts on the earphone microphone can transmit his or her voice input to the microphone while hearing sound such as speaking voice output from the speaker. Therefore, the earphone microphone is used for handsfree communication with a cellular phone or the like.

In general, a canal type of the earphone microphone such as described in JP-A-2007-201887 is often used. When a user puts on a canal type earphone microphone placed in an ear, the external acoustic meatus of the user is sealed by a main body of the earphone microphone. Therefore, the microphone, which is in the closed space including the user's auditory meatus and an inner space of a main body case of the earphone microphone, picks up little external noise. Therefore, noise is hardly mixed into the voice input to the microphone for transmitting the user's voice.

However, in the canal type earphone microphone as described in JP-A-2007-201887, because the microphone picks up sound in the sealed acoustic space, the transmitted voice is apt to have a muffled feeling compared with the real voice. In particular, there is a problem that a high frequency voice is apt to be muffled so that voice deteriorated from the real voice is transmitted. On the other hand, if the earphone microphone is an inner ear type, the voice sound picked up by microphone is hardly with muffled feeling. However, because the user's external acoustic meatus is not sealed by the inner ear type earphone microphone, the microphone easily picks up external noise. Further, low frequency vice output from the speaker becomes hardly heard. Therefore, sound quality is deteriorated.

SUMMARY OF THE INVENTION

The present invention is made in view of the above-mentioned problem, and it is an object of the present invention to provide an earphone microphone that can output sound with good quality and can pick up clear sound.

In order to achieve the above-mentioned object, an earphone microphone according to an embodiment of the present invention includes a speaker, a microphone, a main body case, and a seal member. The seal member seals between the main body case and a user's external acoustic meatus when the earphone microphone is inserted in the user's external acoustic meatus. The main body case is provided with an acoustic space in which a speaker and a microphone are disposed, and a first opening and a second opening communicating with the acoustic space. When the earphone microphone is inserted in the external acoustic meatus, the first opening communicates with the external acoustic meatus while the second opening communicates with the outside of the main body case other than the external acoustic meatus.

Further features and advantages of the present invention will become more apparent from the embodiments described below.

DETAILED DESCRIPTION OF THE PREFERRED EMBODIMENTS

Now, embodiments of the present invention are described with reference to the drawings.

First Embodiment

Figure 1:
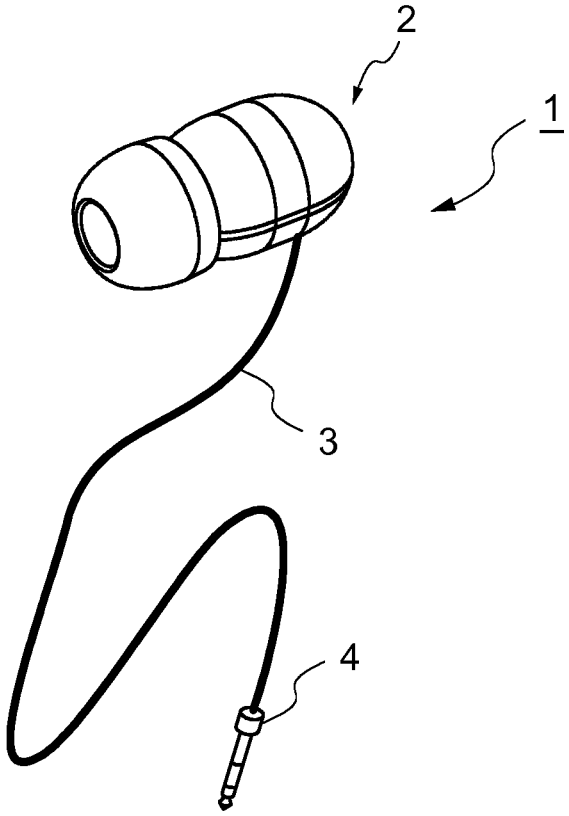
FIG. 1 is an external perspective view of an earphone microphone according to a first embodiment.

FIG. 1 is an external perspective view of an earphone microphone according to a first embodiment. An earphone microphone 1 is a sound input and output device that is connected to electronic equipment (not shown) such as a cellular phone, for example. As illustrated in FIG. 1, the earphone microphone 1 includes a main body 2, a cable 3, and a connector 4.

The main body 2 is placed in a user's ear so as to produce output sound and to pick up input sound from an external sound source (such as user's speaking voice). A specific structure of the main body 2 will be described later. The cable 3 is a signal wire connected between the main body 2 and the connector 4 so as to transmit and receive signals between electronic equipment (not shown) connected to the earphone microphone 1 and the main body 2 via the connector 4. The connector 4 is an input and output terminal connected to an interface of the electronic equipment (not shown).

Figure 2:
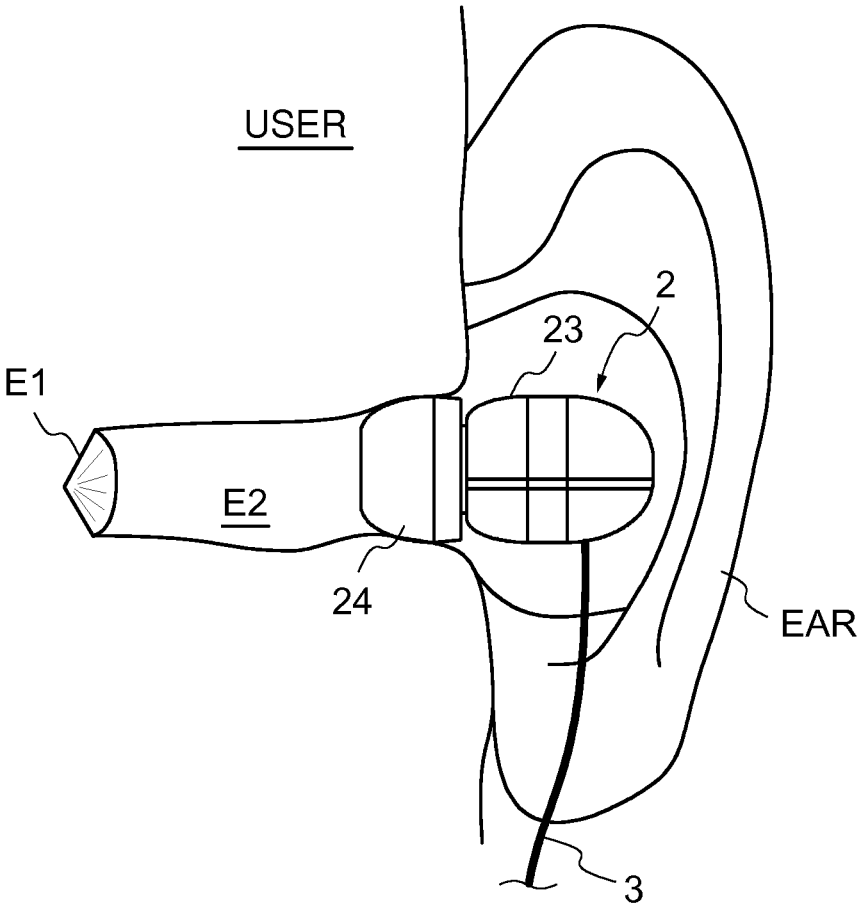
FIG. 2 is a diagram illustrating a state where the earphone microphone is placed in a user's external acoustic meatus.

FIG. 2 is a diagram illustrating a state where the earphone microphone is placed in the user's external acoustic meatus. As illustrated in FIG. 2, the earphone microphone 1 is placed in a user's ear EAR so as to output sound toward user's tympanum E1 based on a sound signal output from the electronic equipment (not shown). In addition, the sound generated by the user is not only output from the mouth, but a part of the sound is transmitted through the skull, the face muscle, and the like to be output from the tympanum E1 to an external acoustic meatus E2. The earphone microphone 1 collects the input sound such as the user's speaking voice and the like and further generates a sound signal based on the collected sound to output the signal to the electronic equipment (not shown). Note that the electronic equipment connected to the earphone microphone 1 is not limited particularly.

Figure 3:
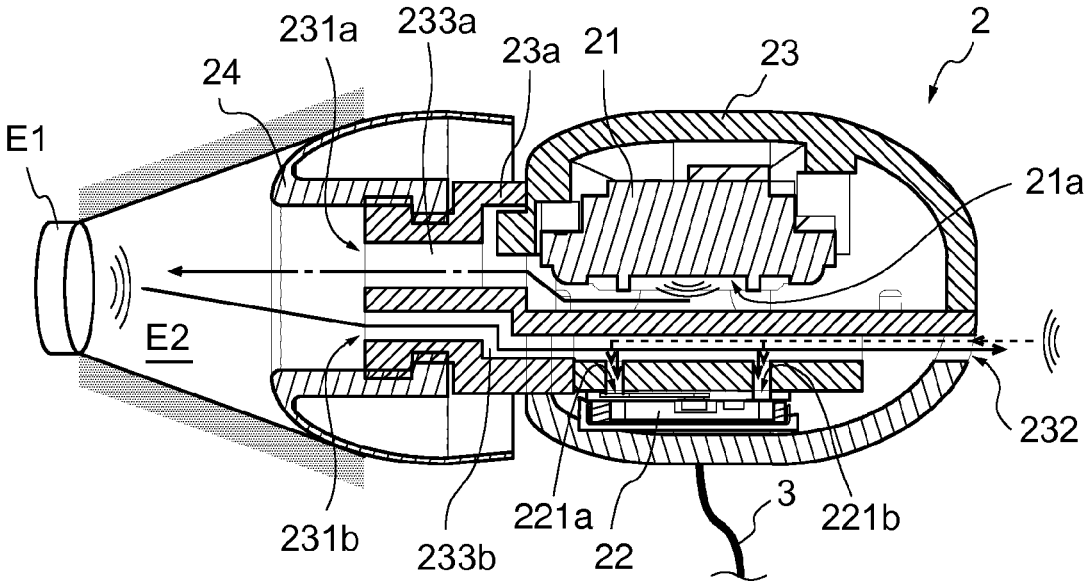
FIG. 3 is a schematic cross-sectional view of a main body of the earphone microphone placed in the user's ear according to the first embodiment.
Figure 4:
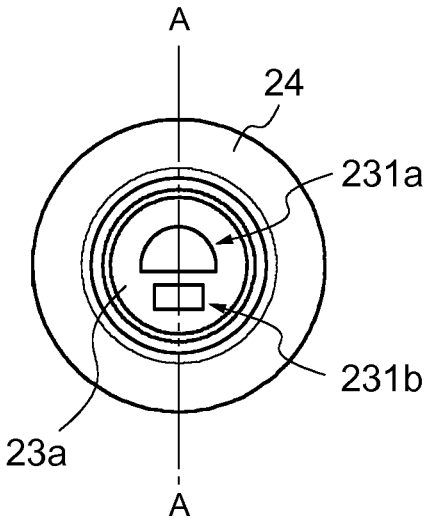
FIG. 4 is a front view of the main body viewed from the user's external acoustic meatus side.
Figure 5:
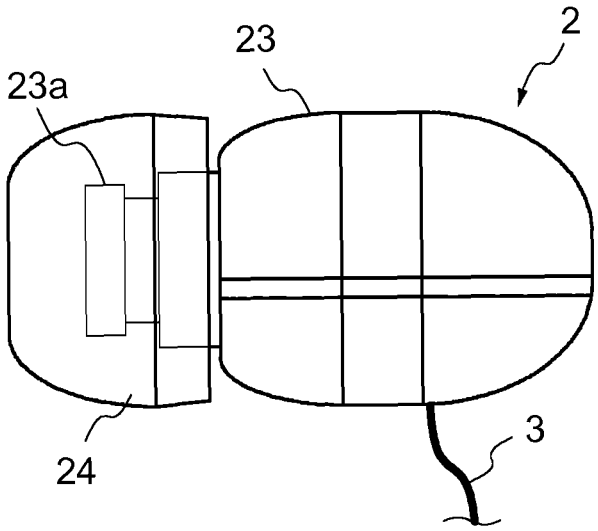
FIG. 5 is a side view of the main body.

Next, a structure of the main body 2 is described in detail. FIG. 3 is a schematic cross-sectional view of the main body of the earphone microphone placed in the user's ear according to the first embodiment. In addition, FIG. 4 is a front view of the main body viewed from the user's external acoustic meatus side. In addition, FIG. 5 is a side view of the main body. Note that FIG. 3 illustrates a cross-sectional structure of the main body 2 taken along the double-dot-dashed line A-A in FIG. 4.

As illustrated in FIG. 3, the main body 2 includes a speaker 21, a microphone 22, a main body case 23 having an insertion part 23*a*, and an ear pad 24. Note that in FIG. 3, a propagation path of the input sound propagating to the microphone 22 via the tympanum E1 and the external acoustic meatus E2 is illustrated by a solid line. In addition, a propagation path of an external sound (so-called noise) propagating from the outside of the main body case 23 other than the external acoustic meatus E2 to the microphone 22 is illustrated by a broken line. In addition, a propagation path of the output sound from the speaker 21 to the external acoustic meatus E2 is illustrated by a dot-dashed line.

The speaker 21 is a sound output part having a sound output hole 21*a* to output the output sound. The speaker 21 is electrically connected to the cable 3 and outputs the output sound based on the sound signal transmitted from the electronic equipment (not shown) via the cable 3 and the connector 4. In FIG. 3, the sound output hole 21*a* of the speaker 21 is directed in the direction substantially perpendicular to an extending direction of a sound output passage 233*a* described later. However, the direction of the speaker 21 is not limited to the example illustrated in FIG. 3. For instance, the direction of the speaker 21 may be substantially parallel to the extending direction of the sound output passage 233*a*.

The microphone 22 is a sound input part having first and second sound input holes 221*a* and 221*b*, and is electrically connected to the cable 3. This microphone 22 is a differential microphone that collects sound in accordance with a sound pressure difference between the first and second sound input holes 221*a* and 221*b*. For instance, an MEMS microphone can be used as the microphone 22, though this is not a limitation. The microphone 22 generates a sound signal based on a sound pressure difference between sound input to the first sound input hole 221*a* and sound input to the second sound input hole 221*b*. The generated sound signal is output to the electronic equipment (not shown) via the cable 3 and the connector 4. In FIG. 3, the first and second sound input holes 221*a* and 221*b* are arranged in the direction substantially parallel to the extending direction of individual sound passages described later, but the arrangement direction thereof is not limited to the example illustrated in FIG. 3.

The ear pad 24 is made of resin material, for example, and covers the insertion part 23*a* of the main body case 23. When the main body 2 is placed in the user's ear EAR (see FIG. 2), the ear pad 24 together with the insertion part 23*a* is inserted in the user's external acoustic meatus E2. In this case, the ear pad 24 seals between the insertion part 23*a* of the main body case 23 and the opening of the user's external acoustic meatus E2 without a substantial gap between them. Therefore, it is possible to substantially block external sound from entering through between the insertion part 23*a* and the opening of the external acoustic meatus E2.

The main body case 23 includes the speaker 21 and the microphone 22. In addition, as illustrated in FIG. 3 and FIG. 4, the main body case 23 is provided with a first opening including a sound output opening 231*a* and a sound input opening 231*b*, and a second opening 232.

The sound output opening 231*a* and the sound input opening 231*b* are formed in the insertion part 23*a*, and in particular are formed on the surface opposed to the user's tympanum E1 as illustrated in FIG. 4 in the state where the main body 2 is placed in the user's ear EAR. The sound output opening 231*a* is an opening for output the output sound of the speaker 21 from the earphone microphone 1. In addition, the sound input opening 231*b* is an opening for transmitting sound from outside (in particular, the external acoustic meatus E2) to the microphone 22. In addition, the second opening 232 is a through hole formed in a part of the main body case 23 other than the insertion part 23*a*.

Figure 6A:
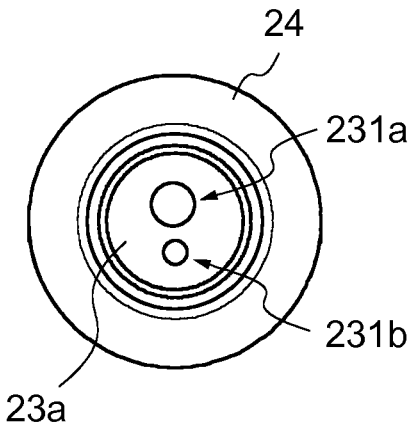
FIG. 6A is a front view of another example of forming a sound output opening and a sound input opening.
Figure 6B:
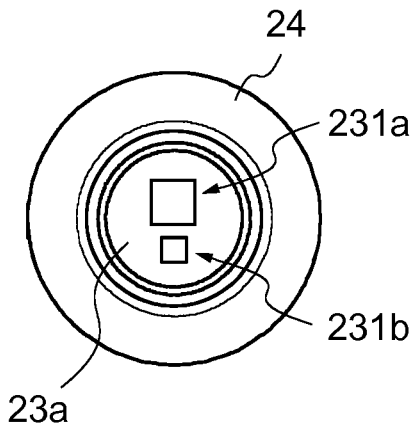
FIG. 6B is a front view of another example of forming the sound output opening and the sound input opening.
Figure 6C:
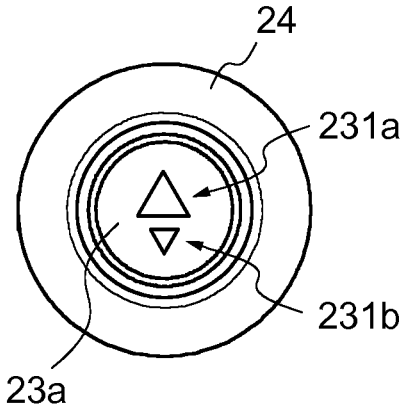
FIG. 6C is a front view of another example of forming the sound output opening and the sound input opening.

Note that shapes of the sound output opening 231*a* and the sound input opening 231*b* formed in the insertion part 23*a* are not particularly limited. FIGS. 6A to 6C are front views of other examples of forming the sound output opening and the sound input opening. The shapes of the sound output opening 231*a* and the sound input opening 231*b* may be circular shapes (FIG. 6A), or polygonal shapes such as rectangular shapes (FIG. 6B) or triangular shapes (FIG. 6C). In addition, the shapes and sizes of the sound output opening 231*a* and the sound input opening 231*b* may be substantially the same or different from each other. Similarly, the shape and size of the second opening 232 are also not particularly limited. It is sufficient that the second opening 232 should have air permeability.

In addition, inside the main body case 23, there is formed an acoustic space including the sound output passage 233*a* and a sound input passage 233*b* as illustrated in FIG. 3. The speaker 21 is disposed in the sound output passage 233*a*, and the microphone 22 is disposed in the sound input passage 233*b*.

The sound output passage 233*a* is a sound passage in which the output sound of the speaker 21 propagates and is communicated with the space outside the main body case 23 inside the ear pad 24 through the sound output opening 231*a*. For instance, in the state where insertion part 23*a* of the main body case 23 is inserted in the user's external acoustic meatus E2, the sound output passage 233*a* is communicated with the external acoustic meatus E2 through the sound output opening 231*a*. Then, the output sound output from the sound output hole 21*a* of the speaker 21 is output in the external acoustic meatus E2 toward the user's tympanum E1.

The sound input passage 233*b* is a sound passage in which the sound to be collected by the microphone 22 propagates. The sound input passage 233*b* is communicated with the outside space inside the ear pad 24 through the sound input opening 231*b*. For instance, in the state where the insertion part 23*a* of the main body case 23 is inserted in the user's external acoustic meatus E2 as illustrated in FIG. 3, the sound input passage 233*b* is communicated with the external acoustic meatus E2 through the sound input opening 231*b*. Then, the input sound such as user's speaking voice output from the tympanum E1 propagates from the external acoustic meatus E2 to the sound input passage 233*b* and is guided to the first and second sound input holes 221*a* and 221*b*. In this case, the sound pressures of the input sounds received by the first and second sound input holes 221*a* and 221*b* are different from each other in accordance with a difference of propagation distance between the input sounds received by first and second sound input holes 221*a* and 221*b*. Therefore, the microphone 22 picks up input sound corresponding to the sound pressure difference between the first and second sound input holes 221*a* and 221*b*.

In addition, the sound input passage 233*b* is communicated with the outside space outside the ear pad 24 through the second opening 232. Therefore, in the state where the insertion part 23*a* of the main body case 23 is inserted in the user's external acoustic meatus E2 as illustrated in FIG. 3, for example, the sound input passage 233*b* is communicated with the outside space of the main body case 23 other than the external acoustic meatus E2 through the second opening 232. In other words, the external acoustic meatus E2 and the acoustic space in the main body case 23 (in particular, the sound input passage 233*b*) are not a completely closed space. Therefore, as described later, the microphone 22 can pick up the input sound with high sensitivity up to a high frequency band. Therefore, it is possible to prevent the picked-up input sound from being with muffled feeling.

Further, external sound (noise) also propagates from the outside of the main body case 23 other than the external acoustic meatus E2 to the sound input passage 233*b* through the second opening 232. However, it is confirmed that the external sound is not substantially picked up by the microphone 22. The reason of this is considered as follows.

First, when external sound propagates to the sound input passage 233*b* through the second opening 232 in the state illustrated in FIG. 3, the external sound can be regarded as sound from the outside to the inside of the closed space including the external acoustic meatus E2 and the acoustic space in the main body case 23 (in particular, the sound input passage 233*b*). Therefore, in accordance with Pascal's principle, the sound pressure of the external sound is substantially uniform in the closed space. Therefore, the first and second sound input holes 221*a* and 221*b* receive substantially the same sound pressure of the external sound. In other words, there is almost no sound pressure difference between the first and second sound input holes 221*a* and 221*b*. Thus, the microphone 22 does not substantially pick up the external sound, and hence it is possible to prevent noise corresponding to the external sound from mixing into the sound picked up by the microphone 22.

Figure 7:
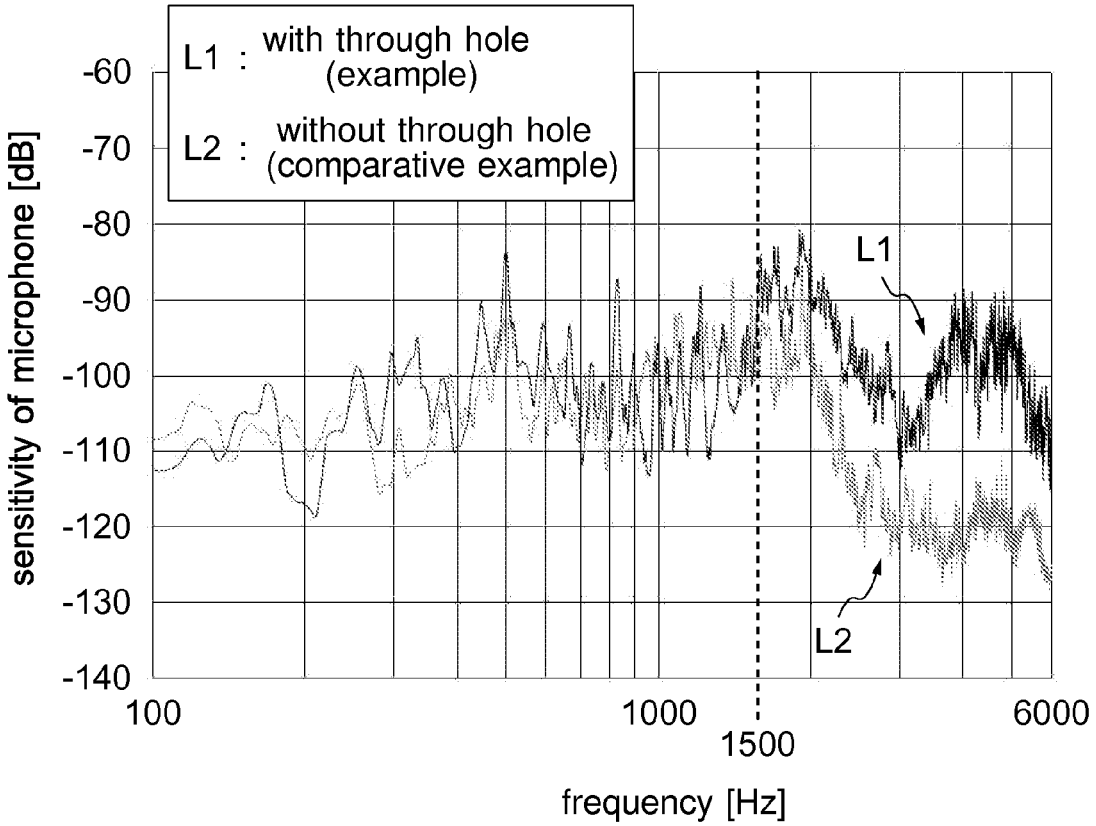
FIG. 7 is a graph illustrating an example of frequency characteristics of input sound picked up by the microphone when the earphone microphone is placed in the user's ear.

Next, there is described an improving effect of frequency characteristics of the input sound collected by the microphone 22 obtained by forming the second opening 232. FIG. 7 is a graph illustrating an example of frequency characteristics of the input sound collected by the microphone in the state where the earphone microphone is placed in the user's ear. FIG. 7 illustrates frequency characteristics of the sound when the user speaks "sho-enerugi wa kokorogake sidaidesu" in the state where the earphone microphone 1 is placed in the ear EAR. In addition, in FIG. 7, a characteristic line L1 indicates frequency characteristics of the input sound collected in this embodiment with the second opening 232. In addition, a characteristic line L2 indicates frequency characteristics of the input sound collected in a comparative example (not shown) without the second opening 232.

As illustrated in FIG. 7, in the high frequency band of approximately 1,500 Hz or higher, the characteristic line L1 shows higher sensitivity than the characteristic line L2. In other words, in the state where the insertion part 23*a* of the main body case 23 is inserted in the external acoustic meatus E2, the sound input passage 233*b* is communicated with the outside of the main body case 23 other than the external acoustic meatus E2 through the second opening 232, and hence sound pickup characteristics of the microphone 22 in the high frequency band can be improved. Therefore, the microphone 22 can pick up clear input sound without the muffled feeling.

As described above, the first embodiment of the present invention is described. The earphone microphone 1 of the first embodiment includes the speaker 21, the microphone 22, the main body case 23, and the ear pad 24. The ear pad 24 seals between the main body case 23 and the user's external acoustic meatus E2 when the main body case 23 is inserted in the external acoustic meatus E2. The main body case 23 is provided with an acoustic space, the first opening including the sound output opening 231*a* and the sound input opening 231*b*, and the second opening 232. The speaker 21 and the microphone 22 are disposed in the acoustic space. In addition, the sound output opening 231*a*, the sound input opening 231*b*, and the second opening 232 are communicated with the acoustic space. When the main body case 23 is inserted in the external acoustic meatus E2, the sound output opening 231*a* and the sound input opening 231*b* are communicated with the external acoustic meatus E2 while the second opening 232 is communicated with the outside of the main body case 23 other than the external acoustic meatus E2.

With this structure, when the earphone microphone 1 is inserted in the user's external acoustic meatus E2, the ear pad 24 seals between the main body case 23 of the earphone microphone 1 and the external acoustic meatus E2. Therefore, the output sound of the speaker 21 is output to the user's external acoustic meatus E2 through the sound output opening 231*a* without being deteriorated. In addition, the acoustic space in which the speaker 21 and the microphone 22 are disposed is communicated with the external acoustic meatus E2 through the sound output opening 231*a* and the sound input opening 231*b*. Further, the acoustic space is communicated with the outside of the main body case 23 other than the external acoustic meatus E2 through the second opening 232. Therefore, the acoustic space is not a closed space. Therefore, the input sound to the sound input passage 233*b* of the main body case 23 from the external acoustic meatus E2 is picked up by the microphone 22 through the sound input opening 231*b* without muffled feeling. Therefore, it is possible to output sound with good quality and to pick up clear sound.

In addition, in the first embodiment, the microphone 22 is the differential microphone having the first and second sound input holes 221*a* and 221*b*. In this way, in the state where the main body case 23 is inserted in the external acoustic meatus E2, there is generated a sound pressure difference between the first and second sound input holes 221*a* and 221*b* for the input sound from the external acoustic meatus E2. On the other hand, there is not generated a sound pressure difference of the external sound (such as noise) from the outside of the main body case other than the external acoustic meatus 23. Therefore, the microphone 22 picks up the input sound in accordance with the sound pressure difference between the first and second sound input holes 221*a* and 221*b* but does not pick up the external sound. Thus, it is possible to prevent the external sound in the outside of the main body case 23 other than the external acoustic meatus E2 from being picked up by the microphone 22.

In addition, in the first embodiment, the acoustic space includes the sound output passage 233*a* in which the speaker 21 is disposed and the sound input passage 233*b* in which the microphone 22 is disposed. In addition, the first opening formed in the main body case 23 includes the sound output opening 231*a* communicated with the sound output passage 233*a*, and the sound input opening 231*b* communicated with the sound input passage 233*b*. In addition, the second opening 232 is communicated with the sound input passage 233*b*.

With this structure, the sound output passage 233*a* in which the speaker 21 is disposed is communicated with the external acoustic meatus E2 through the sound output opening 231*a*. In addition, the sound input passage 233*b* in which the microphone 22 is disposed is communicated with the external acoustic meatus E2 through the sound input opening 231*b*, and further is communicated with the outside of the main body case 23 other than the external acoustic meatus E2 through the second opening 232. Therefore, because the output sound of the speaker 21 is not directly output to the microphone 22 in the acoustic space, the output sound of the speaker 21 is hardly picked up by the microphone 22.

Second Embodiment

Next, the earphone microphone 1 of the second embodiment is described. In the second embodiment, a root of the cable 3 is covered with a sheath member 3*a*. In addition, the second opening 232 is communicated with the outside of the main body case 23 through a gap between the sheath member 3*a* and the cable 3. Other than that is the same as the first embodiment. In the following description, the same structural element as the first embodiment is denoted by the same numeral or symbol, and description thereof is omitted.

Figure 8:
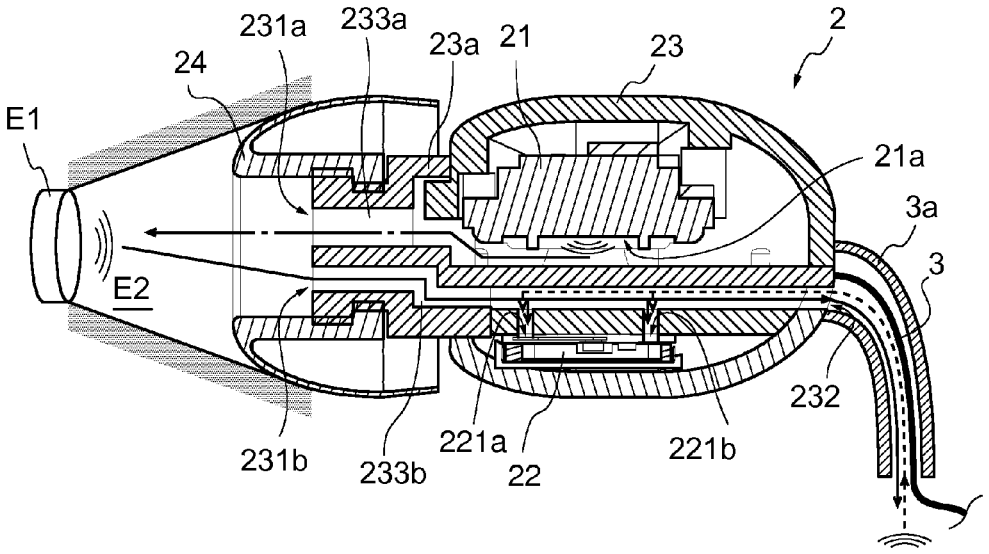
FIG. 8 is a schematic cross-sectional view of a main body of an earphone microphone placed in the user's ear according to a second embodiment.

FIG. 8 is a schematic cross-sectional view of the main body of the earphone microphone placed in the user's ear according to the second embodiment. In FIG. 8, the propagation path of the input sound propagating to the microphone 22 via the tympanum E1 and the external acoustic meatus E2 is illustrated by a solid line. In addition, the propagation path of the external sound (so-called noise) propagating from the outside of the main body case 23 other than the external acoustic meatus E2 to the microphone 22 is illustrated by a broken line. In addition, the propagation path of the output sound from the speaker 21 to the external acoustic meatus E2 is illustrated by a dot-dashed line.

As illustrated in FIG. 8, in the second embodiment, the cable 3 extends from the main body case 23 at a vicinity of the second opening 232. In addition, the root of the cable 3 (a part extending from the main body case 23) is covered with the sheath member 3*a* having a tube-like shape. In addition, there is a gap between the cable 3 and the sheath member 3*a* so as to have at least air permeability. Through this gap, the second opening 232 is communicated with the outside space of the main body case 23.

When this main body 2 is placed in the user's ear EAR, the input sound propagates from the external acoustic meatus E2 to the sound input passage 233*b* and is guided to the first and second sound input holes 221*a* and 221*b*. Then, the microphone 22 picks up the input sound in accordance with a sound pressure difference between the first and second sound input holes 221*a* and 221*b*. In addition, in this case, the sound input passage 233*b* is communicated with the outside space of the main body case 23 other than the external acoustic meatus E2 through the second opening 232, and the gap between the sheath member 3*a* and the cable 3 as illustrated in FIG. 8. In other words, the external acoustic meatus E2 and the acoustic space in the main body case 23 (in particular, the sound input passage 233*b*) are not a completely closed space. Therefore, the microphone 22 can pick up the input sound with good sensitivity up to the high frequency band. Therefore, the input sound from the external acoustic meatus E2 to the sound input passage 233*b* of the main body case 23 through the sound input opening 231*b* is picked up by the microphone 22 without muffled feeling.

On the other hand, the external sound propagating from the outside space other than the external acoustic meatus E2 to the sound input passage 233*b* is not substantially picked up by the microphone 22. Therefore, it is possible to prevent noise corresponding to the external sound (so-called noise) from mixing into the sound picked up by the microphone 22.

As described above, the second embodiment of the present invention is described. The earphone microphone 1 of the second embodiment further includes the cable 3 and the sheath member 3*a*. The cable 3 transmits an output signal of the microphone 22, and the sheath member 3*a* covers the cable 3 extending from the main body case 23. In addition, the second opening 232 is communicated with the outside of the main body case 23 through a gap between the cable 3 and the sheath member 3*a*. In this way, the second opening 232 is not directly communicated with the outside of the main body case 23. Therefore, it is possible that dust from the outside hardly enter the acoustic space (the sound output passage 233*a* and the sound input passage 233*b*) through the second opening 232.

Third Embodiment

Next, the earphone microphone 1 according to a third embodiment is described. In the third embodiment, the sound output passage 233*a* and the sound input passage 233*b* make the same acoustic space 233. Other than that is the same as the first and second embodiments. In the following description, the same structural element as the first and second embodiments is denoted by the same numeral or symbol, and description thereof is omitted.

Figure 9:
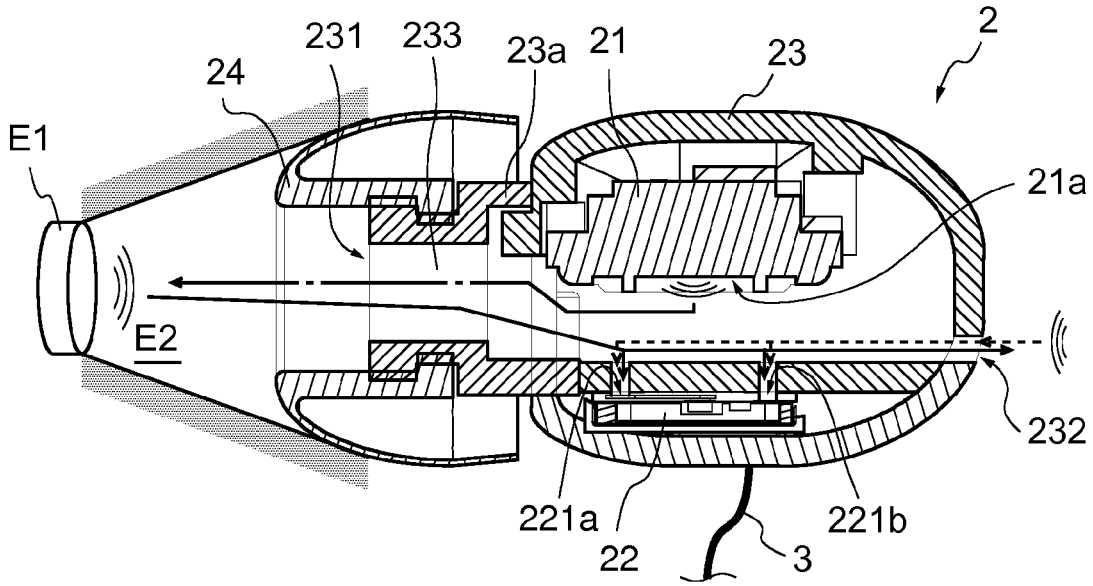
FIG. 9 is a schematic cross-sectional view of a main body of an earphone microphone placed in the user's ear according to a third embodiment.

FIG. 9 is a schematic cross-sectional view of a main body of the earphone microphone placed in the user's ear according to the third embodiment. In FIG. 9, the propagation path of the input sound propagating to the microphone 22 through the tympanum E1 and the external acoustic meatus E2 is illustrated by a solid line. In addition, the propagation path of the external sound (so-called noise) propagating from the outside of the main body case 23 other than the external acoustic meatus E2 to the microphone 22 is illustrated by a broken line. In addition, the propagation path of the output sound from the speaker 21 to the external acoustic meatus E2 is illustrated by a dot-dashed line.

As illustrated in FIG. 9, in the third embodiment, the insertion part 23*a* of the main body case 23 is provided with a first opening 231. In particular, in the state where the main body 2 is placed in the user's ear EAR, the first opening 231 is formed in a surface opposed to the user's tympanum E1. In addition, the second opening 232 is formed in the other part than the insertion part 23*a* of the main body case 23. In addition, the speaker 21 and the microphone 22 are disposed in the acoustic space 233 formed in the main body case 23. This acoustic space 233 is communicated with the outside of the main body case 23 through the first opening 231 and the second opening 232.

When this main body 2 is placed in the user's ear EAR, the input sound propagates from the external acoustic meatus E2 to the acoustic space 233 and is guided to the first and second sound input holes 221*a* and 221*b*. Then, the microphone 22 picks up the input sound in accordance with the sound pressure difference between the first and second sound input holes 221*a* and 221*b*. In addition, in this case, the acoustic space 233 is communicated also with the outside space of the main body case 23 other than the external acoustic meatus E2 through the second opening 232 as illustrated in FIG. 9. In other words, the external acoustic meatus E2 and the acoustic space 233 are not a completely closed space. Therefore, the microphone 22 can pick up the input sound with high sensitivity up to the high frequency band. Therefore, the input sound entering from the external acoustic meatus E2 to the acoustic space 233 of the main body case 23 through the first opening 231 can be picked up by the microphone 22 without muffled feeling.

On the other hand, the external sound propagating from the outside space other than the external acoustic meatus E2 to the acoustic space 233 is not substantially picked up by the microphone 22. Therefore, it is possible to prevent noise corresponding to the external sound from mixing into the sound picked up by the microphone 22.

As described above, the third embodiment of the present invention is described. The earphone microphone 1 of the third embodiment includes the speaker 21, the microphone 22, the main body case 23, and the ear pad 24. The ear pad 24 seals between the main body case 23 and the external acoustic meatus E2 when being inserted in the user's external acoustic meatus E2. The main body case 23 is provided with the acoustic space 233 in which the speaker 21 and the microphone 22 are disposed, and the first opening 231 and the second opening 232 communicated with the acoustic space 233. When the earphone microphone 1 is inserted in the external acoustic meatus E2, the first opening 231 is communicated with the external acoustic meatus E2 while the second opening 232 is communicated with the outside of the main body case 23 other than the external acoustic meatus E2.

With this structure, when the earphone microphone 1 is inserted in the user's external acoustic meatus E2, the ear pad 24 seals between the main body case 23 of the earphone microphone 1 and the external acoustic meatus E2. Therefore, the output sound of the speaker 21 is not deteriorated and is output to the user's external acoustic meatus E2 through the first opening 231. In addition, the acoustic space 233 in which the speaker 21 and the microphone 22 are disposed is communicated with the external acoustic meatus E2 through the first opening 231 and is communicated with the outside of the main body case 23 other than the external acoustic meatus E2 through the second opening 232 without being a closed space. Therefore, the input sound from the external acoustic meatus E2 to the acoustic space 233 of the main body case 23 through the first opening 231 is picked up by the microphone 22 without muffled feeling. Therefore, it is possible to output sound with good quality and to pick up clear input sound.

Fourth Embodiment

Next, the earphone microphone 1 of a fourth embodiment is described. In the fourth embodiment, the microphone 22 includes a first microphone 22*a* having the first sound input hole 221*a* and a second microphone 22*b* having the second sound input hole 221*b* (see FIG. 12 that will be referred to later). In addition, the earphone microphone 1 generates a differential sound signal based on output signals from the first and second microphones 22*a* and 22*b*. Other than that is the same as the first to third embodiments. In the following description, the same structural element as the first to third embodiments is denoted by the same numeral or symbol, and description thereof is omitted.

Figure 10:
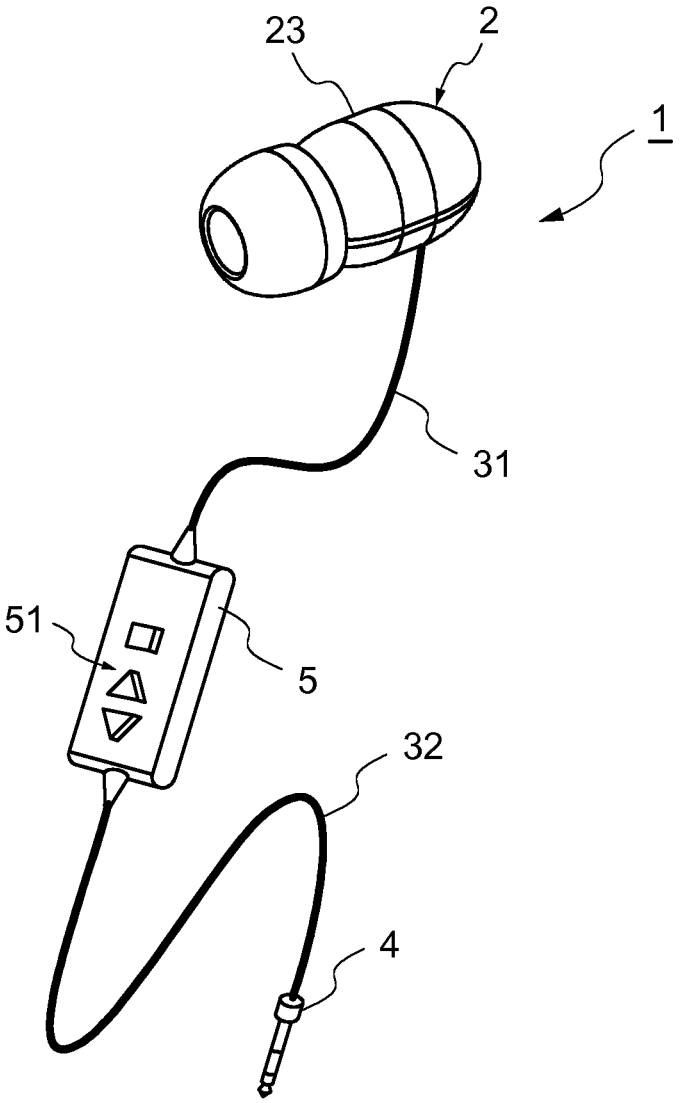
FIG. 10 is an external perspective view of an earphone microphone according to a fourth embodiment.

FIG. 10 is an external perspective view of the earphone microphone according to the fourth embodiment. As illustrated in FIG. 10, in the fourth embodiment, the earphone microphone 1 further includes a control unit 5. A first cable 31 is connected between the main body 2 and the control unit 5 so that a signal is sent and received between the main body 2 and the control unit 5. A second cable 32 is connected between the control unit 5 and the connector 4 so that a signal is sent and received via the connector 4 between the control unit 5 and the electronic equipment (not shown) to which the earphone microphone 1 is connected.

Figure 11:
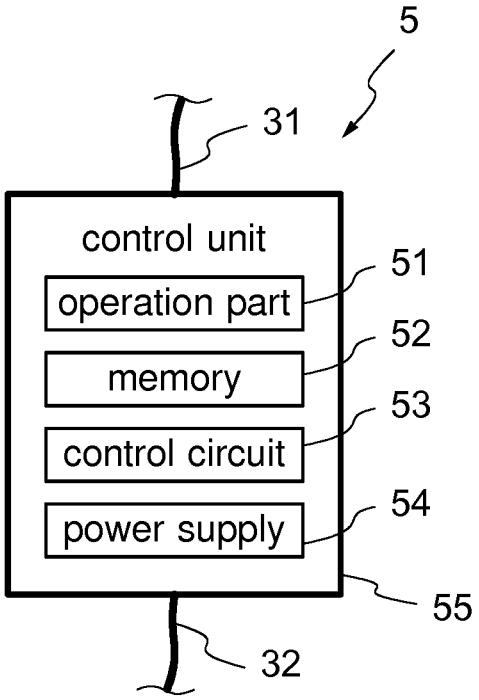
FIG. 11 is a block diagram illustrating a structure of a control unit.

Next, a structure of the control unit 5 is described. FIG. 11 is a block diagram illustrating a structure of the control unit. As illustrated in FIG. 11, the control unit 5 includes an operation part 51, a memory 52, a control circuit 53, a power supply 54, and a case 55.

The operation part 51 accepts a user input such as volume adjustment of the speaker 21 so as to output the corresponding control signal to the control circuit 53. In addition, the memory 52 is a nonvolatile storage medium and stores programs, control signals, and the like for controlling individual parts of the earphone microphone 1 (in particular, the control circuit 53) in a non-temporary manner.

The control circuit 53 controls individual structural parts of the earphone microphone 1 using the programs, the control signals, and the like stored in the memory 52. In addition, the control circuit 53 generates a sound signal from the output signal output from the microphone 22. This sound signal is sent to the electronic equipment (not shown) to which the earphone microphone 1 is connected via the second cable 32 and the connector 4.

The power supply 54 is a small battery for supplying driving power to the control circuit 53 and other structural pasts. As the power supply 54, there are a button battery, a lithium-ion battery, a lithium-polymer battery, and the like, though it is not particularly limited.

The case 55 is a housing for mounting the operation part 51, the memory 52, the control circuit 53, the power supply 54, and the like. In addition, outside the case 55, there is disposed the operation part 51 (see FIG. 10). In addition, on the opposite side to the operation part 51, there is disposed a clip (not shown) for clipping the case 55 to user's clothing (for example, a collar, a pocket, or the like).

Figure 12:
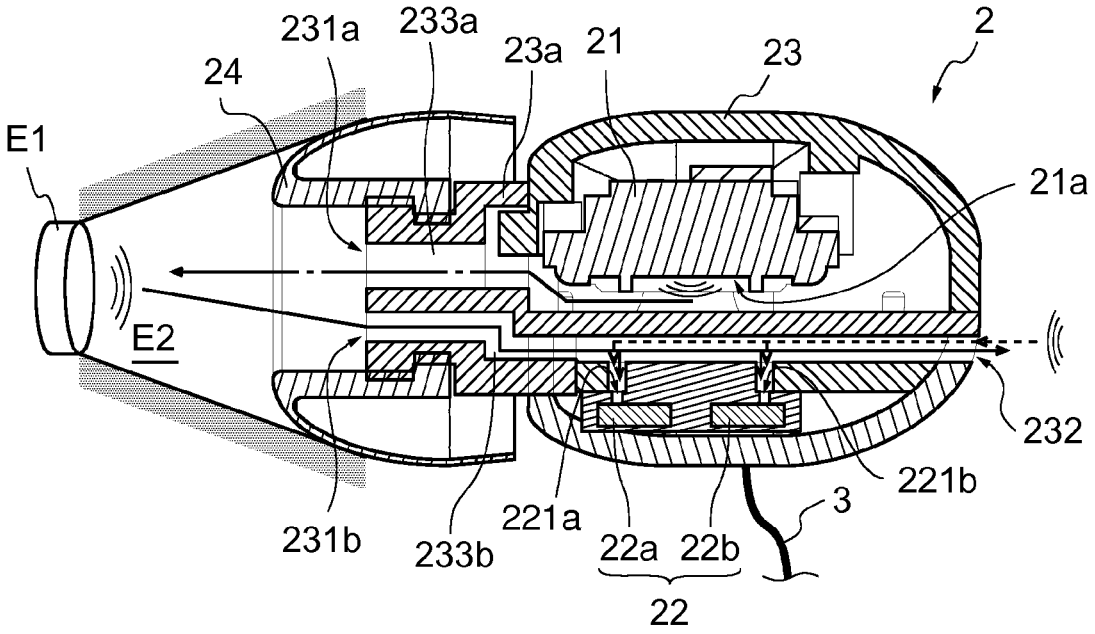
FIG. 12 is a schematic cross-sectional view of a main body of the earphone microphone placed in the user's ear according to the fourth embodiment.

Next, a structure of the main body 2 according to the fourth embodiment is described. FIG. 12 is a schematic cross-sectional view of the main body of the earphone microphone placed in the user's ear according to the fourth embodiment. In FIG. 12, the propagation path of the input sound propagating to the microphone 22 through the tympanum E1 and the external acoustic meatus E2 is illustrated by a solid line. In addition, the propagation path of the external sound (so-called noise) propagating from the outside of the main body case 23 other than the external acoustic meatus E2 to the microphone 22 is illustrated by a broken line. In addition, the propagation path of the output sound from the speaker 21 to the external acoustic meatus E2 is illustrated by a dot-dashed line. In addition, the structure of the main body 2 other than the microphone 22 in FIG. 12 is the same as the structure illustrated in FIG. 3, but the fourth embodiment is not limited to this structure. The structure of the main body 2 other than the microphone 22 may be the same as illustrated in FIG. 8 or 9.

As illustrated in FIG. 12, the microphone 22 includes the first and second microphones 22*a* and 22*b*. The first and second microphones 22*a* and 22*b* are electrically connected to the control unit 5 (in particular, the control circuit 53) via the first cable 31. The first microphone 22*a* has the first sound input hole 221*a* and generates a first output signal based on sound input to the first sound input hole 221*a*. In addition, the second microphone 22*b* has the second sound input hole 221*b* and generates a second output signal based on sound input to the second sound input hole 221*b*. The generated first and second output signals are output to the control unit 5 via the first cable 31. The first and second microphones 22*a* and 22*b* are not particularly limited, but an ECM microphone or the like can be used for them.

When this main body 2 is placed in the user's ear EAR, the input sound propagates from the external acoustic meatus E2 to the sound input passage 233*b*. Then, there is generated a differential sound signal corresponding to a sound pressure difference between the first and second sound input holes 221*a* and 221*b* based on the first and second output signal output from the first and second microphones 22*a* and 22*b*. In addition, in this case, the sound input passage 233*b* is communicated with the outside space of the main body case 23 other than the external acoustic meatus E2 through the second opening 232 as illustrated in FIG. 12. In other words, the acoustic space in the external acoustic meatus E2 and the main body case 23 (in particular, the sound input passage 233*b*) are not a completely closed space. Therefore, the input sound can be picked up by the first and second microphones 22*a* and 22*b* with good sensitivity up to the high frequency band without muffled feeling. Therefore, the control circuit 53 generates a differential sound signal based on the input sound picked up with good sensitivity up to the high frequency band.

On the other hand, the external sound propagating from the outside space other than the external acoustic meatus E2 to the sound input passage 233*b* applies substantially the same sound pressure to the first and second sound input holes 221*a* and 221*b*. Therefore, no signal component corresponding to the external sound (namely, a noise component) is superimposed on the differential sound signal generated by the control circuit 53.

As described above, the fourth embodiment of the present invention is described. The earphone microphone 1 of the fourth embodiment further includes the control circuit 53 that generates the differential sound signal based on the output signal of the microphone 22. In addition, the microphone 22 includes the first microphone 22*a* having the first sound input hole 221*a* and the second microphone 22*b* having the second sound input hole 221*b*.

With this structure, the differential sound signal is generated based on the output signals of the first and second microphones 22*a* and 22*b*. In the state where the main body case 23 is inserted in the external acoustic meatus E2, there is a sound pressure difference between the input sounds from the external acoustic meatus E2 to the first and second sound input holes 221*a* and 221*b*. On the other hand, there is no sound pressure difference between the external sounds from the outside of the main body case 23 other than the external acoustic meatus E2. Therefore, intensity of the output signal corresponding to the input sound is different between the first and second microphones 22*a* and 22*b*, but intensity of the output signal corresponding to the external sound is the same between the first and second microphones 22*a* and 22*b*. Therefore, the control circuit 53 can generate the differential sound signal corresponding to the input sound without superimposing noise corresponding to the external sound.

As described above the embodiments of the present invention are described. The embodiments described above are merely examples, and the structural elements thereof and a combination of the processes can be modified variously within the scope of the present invention as easily understood by a skilled person in the art.

For instance, in the first to fourth embodiments described above, the first opening 231 (the sound output opening 231*a* and the sound input opening 231*b*) and the second opening 232 are communicated with the outside of the main body case 23, but it is possible to dispose a dust-proof member (not shown) in all the openings or in at least one of them. In addition, the dust-proof member may be disposed in the first opening 231 (the sound output opening 231*a* and the sound input opening 231*b*) and in the second opening 232 or may be attached to them. As the dust-proof member, it is possible to use mesh, sponge, felt, porous film, or the like. In addition, material of the dust-proof member is not particularly limited, but it is possible to use resin material such as nylon, polyimide, or the like. Further, it is preferred that the dust-proof member provided to the first opening 231 (the sound output opening 231*a* and the sound input opening 231*b*) should have material and structure such that attenuation of the propagating sound is small. In addition, it is preferred that the dust-proof member provided to the second opening 232 should have material and structure such as to have air permeability. In this way, the dust-proof member can prevent dust from entering the acoustic space 233 (the sound output passage 233*a* and the sound input passage 233*b*).

In addition, in the first to fourth embodiments described above, the earphone microphone 1 has the main body 2 as illustrated in FIGS. 1 and 10, but the present invention is not limited to this structural example. The earphone microphone 1 may have two main bodies 2. Then, the user can hear the output sound of the speaker 21 by both ears. Further, it is possible to adopt a structure in which one of the two main bodies 2 includes the speaker 21 but does not include the microphone 22. Alternatively, it is possible to adopt a structure in which when the earphone microphone 1 simultaneously performs output of the output sound and pickup of the input sound, one of the main, bodies 2 performs only output of the output sound by the speaker 21 while the other main body 2 performs only pickup of the input sound by the microphone 22.

What is claimed is:

1. An earphone microphone comprising a speaker, a microphone having first and second sound input holes, a case, a seal member for sealing between the case and an external acoustic meatus when the earphone microphone is inserted in the external acoustic meatus, wherein the case comprises:

an acoustic space, a first opening which faces the external acoustic meatus, and a second opening which faces outside the casing except the external acoustic meatus, the acoustic space is divided into a first acoustic space and a second acoustic space, the second acoustic space having a volume smaller than a volume of the first acoustic space, the first acoustic space communicates with the first opening, and the speaker is arranged in the first acoustic space, and the second acoustic space communicates with the first and second openings, and the microphone is arranged in the second acoustic space, and the first and second sound input holes face the second acoustic space.

2. An earphone microphone according to claim 1, wherein the case has a partition wall that separates the first and second acoustic spaces from each other.

3. An earphone microphone according to claim 1, further comprising a controller configured to generate a sound signal based on an output signal of the microphone, wherein the microphone includes a first microphone having the first sound input hole and a second microphone having the second sound input hole.

4. An earphone microphone according to claim 1, further comprising a signal wire for transmitting an output signal of the microphone, and a sheath member for covering the signal wire extending from the case, wherein the second opening communicates with outside the case through a gap between the sheath member and the signal wire.

5. An earphone microphone according to claim 1, wherein the sheath member has an opening that faces outside the case and communicates with the second opening.

6. An earphone microphone according to claim 4, wherein the first opening comprises a plurality of first openings, and the first acoustic space communicates with a part of the plurality of first openings, and the second acoustic space communicates with another part of the plurality of first openings.

7. An earphone microphone comprising a microphone, a case, and a seal member for sealing between the case and an external acoustic meatus when the earphone microphone is inserted into the external acoustic meatus, wherein, the case has formed therein:

a plurality of first openings that face the external acoustic meatus, a second opening that faces outside the casing except the external acoustic meatus, a first acoustic space that communicates with a part of the plurality of first openings and in which the speaker is arranged, and a second acoustic space that communicates with another part of the plurality of first openings and with the second opening and in which the microphone is arranged, and the case has a partition wall that separates the first and second acoustic spaces from each other.

8. An earphone microphone according to claim 7, wherein the microphone is a differential microphone having a first sound input hole and a second sound input hole.

9. An earphone microphone according to claim 7, further comprising a controller configured to generate a sound signal based on an output signal of the microphone, wherein the microphone includes a first microphone having a first sound input hole and a second microphone having a second sound input hole.

10. An earphone microphone according to claim 7, further comprising a signal wire for transmitting an output signal of the microphone, and a sheath member for covering the signal wire extending from the case, wherein the second opening communicates with outside the case through a gap between the sheath member and the signal wire.

11. An earphone microphone according to claim 10, wherein the sheath member has an opening that faces outside the case and communicates with the second opening.

12. An earphone microphone comprising a microphone, a case, a seal member for sealing between the case and an external acoustic meatus when the earphone microphone is inserted in the external acoustic meatus, a signal wire for transmitting an output signal of the microphone, and a sheath member for covering the signal wire extending from the case, wherein, the case has formed therein a first opening that faces the external acoustic meatus, a second opening that faces outside the casing except the external acoustic meatus, and an acoustic space that communicates with the first and second openings and in which the speaker and the microphone are arranged, the sheath member has an opening that faces outside the case and communicates with the second opening, and the second opening communicates with outside the case through a gap between the sheath member and the signal wire.

13. An earphone microphone according to claim 12, wherein the microphone is a differential microphone having a first sound input hole and a second sound input hole.

14. An earphone microphone according to claim 12, further comprising a controller configured to generate a sound signal based on an output signal of the microphone, wherein the microphone includes a first microphone having a first sound input hole and a second microphone having a second sound input hole.

* * * * *